US009855192B2

(12) United States Patent
Kim et al.

(10) Patent No.: US 9,855,192 B2
(45) Date of Patent: Jan. 2, 2018

(54) SYRINGE ADAPTER WITH COMPOUND MOTION DISENGAGEMENT

(71) Applicant: Becton Dickinson and Company Limited, Dun Laoghaire (IE)

(72) Inventors: Jayeon Kim, Little Ferry, NJ (US); Laurie Sanders, Glen Ridge, NJ (US); Jude Cancellieri, Oakland, NJ (US)

(73) Assignee: Becton Dickinson and Company Limited, Dun Laoghaire (IE)

( * ) Notice: Subject to any disclaimer, the term of this patent is extended or adjusted under 35 U.S.C. 154(b) by 434 days.

(21) Appl. No.: 14/691,814

(22) Filed: Apr. 21, 2015

(65) Prior Publication Data

US 2015/0297453 A1 Oct. 22, 2015

Related U.S. Application Data

(60) Provisional application No. 61/982,091, filed on Apr. 21, 2014.

(51) Int. Cl.
*A61J 1/20* (2006.01)

(52) U.S. Cl.
CPC ..... *A61J 1/2048* (2015.05); *A61J 1/2055* (2015.05); *A61J 1/2096* (2013.01)

(58) Field of Classification Search
CPC ... F16L 37/084; F16L 37/113; F16L 37/1205; F16L 37/1215; A61J 1/2055; A61J 1/2096; A61J 1/2048
USPC ..... 604/905, 86
See application file for complete search history.

(56) References Cited

U.S. PATENT DOCUMENTS

| | | | |
|---|---|---|---|
| 4,436,125 | A | 3/1984 | Blenkush |
| 4,564,054 | A | 1/1986 | Gustavsson |
| 4,673,404 | A | 6/1987 | Gustavsson |
| 4,932,937 | A | 6/1990 | Gustavsson et al. |
| 5,052,725 | A | 10/1991 | Meyer et al. |
| 5,104,158 | A | 4/1992 | Meyer et al. |
| 5,122,129 | A | 6/1992 | Olson et al. |
| 5,280,876 | A | 1/1994 | Atkins |

(Continued)

FOREIGN PATENT DOCUMENTS

| | | | |
|---|---|---|---|
| EP | 2462971 | A1 | 6/2012 |
| WO | 0128490 | A1 | 4/2001 |

(Continued)

*Primary Examiner* — David E Bochna
(74) *Attorney, Agent, or Firm* — The Webb Law Firm

(57) ABSTRACT

An adapter for connection with a fluid container includes an outer housing having a distal end, a proximal end, and a generally cylindrical sidewall extending between the distal end and the proximal end, an inner member comprising a body rotatably inserted within the outer housing, a first locking arrangement configured to restrict the inner member from rotating relative to the housing in a first direction, and a second locking arrangement configured to restrict the inner member from rotating relative to the housing in both the first direction and a second direction. The adapter is transitionable between: a disengaged state, in which the first locking arrangement and the second locking arrangement are not engaged with the inner member; a partially engaged state in which the first locking arrangement engages the inner member; and a fully engaged state in which the second locking arrangement engages the inner member.

20 Claims, 15 Drawing Sheets

(56) References Cited

U.S. PATENT DOCUMENTS 5,290,254 A 3/1994 Vaillancourt
5,322,518 A 6/1994 Schneider et al.
5,334,188 A 8/1994 Inoue et al.
5,360,011 A 11/1994 McCallister
5,395,348 A 3/1995 Ryan
5,437,650 A 8/1995 Larkin et al.
5,464,123 A 11/1995 Scarrow
5,472,430 A 12/1995 Vaillancourt et al.
5,478,328 A 12/1995 Silverman et al.
5,487,728 A 1/1996 Vaillancourt
5,507,733 A 4/1996 Larkin et al.
5,509,911 A 4/1996 Cottone, Sr. et al.
5,545,152 A 8/1996 Funderburk et al.
5,607,392 A 3/1997 Kanner
5,609,584 A 3/1997 Gettig et al.
5,611,792 A 3/1997 Gustafsson
5,647,845 A 7/1997 Haber et al.
5,685,866 A 11/1997 Lopez
5,807,347 A 9/1998 Bonaldo
5,897,526 A 4/1999 Vaillancourt
6,063,068 A 5/2000 Fowles et al.
6,089,541 A 7/2000 Weinheimer et al.
6,113,583 A 9/2000 Fowles et al.
6,132,404 A 10/2000 Lopez
6,139,534 A 10/2000 Niedospial, Jr. et al.
6,221,041 B1 4/2001 Russo
6,221,056 B1 4/2001 Silverman
6,343,629 B1 2/2002 Wessman et al.
6,358,236 B1 3/2002 DeFoggi et al.
6,378,714 B1 4/2002 Jansen et al.
6,409,708 B1 6/2002 Wessman
6,474,375 B2 11/2002 Spero et al.
6,478,788 B1 11/2002 Aneas
6,544,246 B1 4/2003 Niedospial, Jr.
6,551,299 B2 4/2003 Miyoshi et al.
6,585,695 B1 7/2003 Adair et al.
6,599,273 B1 7/2003 Lopez
6,610,040 B1 8/2003 Fowles et al.
6,629,958 B1 10/2003 Spinello
6,656,433 B2 12/2003 Sasso
6,715,520 B2 4/2004 Andreasson et al.
6,814,726 B1 11/2004 Lauer
6,852,103 B2 2/2005 Fuller et al.
6,875,203 B1 4/2005 Fowles et al.
6,875,205 B2 4/2005 Leinsing
6,911,025 B2 6/2005 Miyahara
6,997,917 B2 2/2006 Niedospial, Jr. et al.
7,040,598 B2 5/2006 Raybuck
7,083,605 B2 8/2006 Miyahara
7,097,209 B2 8/2006 Unger et al.
7,261,707 B2 8/2007 Frezza et al.
7,306,584 B2 12/2007 Wessman et al.
7,326,194 B2 2/2008 Zinger et al.
7,350,535 B2 4/2008 Liepold et al.
7,354,427 B2 4/2008 Fangrow
7,452,349 B2 11/2008 Miyahara
7,547,300 B2 6/2009 Fangrow
7,628,772 B2 12/2009 McConnell et al.
7,648,491 B2 1/2010 Rogers
7,658,734 B2 2/2010 Adair et al.
7,743,799 B2 6/2010 Mosler et al.
7,744,581 B2 6/2010 Wallen et al.
7,758,560 B2 7/2010 Connell et al.
7,803,140 B2 9/2010 Fangrow, Jr.
7,857,805 B2 12/2010 Raines
7,867,215 B2 1/2011 Akerlund et al.
7,879,018 B2 2/2011 Zinger et al.
7,900,659 B2 3/2011 Whitley et al.
7,927,316 B2 4/2011 Proulx et al.
7,942,860 B2 5/2011 Horppu
7,975,733 B2 7/2011 Horppu et al.
8,096,525 B2 1/2012 Ryan
8,122,923 B2 2/2012 Kraus et al.
8,123,738 B2 2/2012 Vaillancourt
8,137,332 B2 3/2012 Pipelka
8,167,863 B2 5/2012 Yow
8,177,768 B2 5/2012 Leinsing
8,196,614 B2 6/2012 Kriheli
8,206,367 B2 6/2012 Warren et al.
8,211,069 B2 7/2012 Fangrow, Jr.
8,225,826 B2 7/2012 Horppu et al.
8,226,628 B2 7/2012 Muramatsu et al.
8,257,286 B2 9/2012 Meyer et al.
8,267,127 B2 9/2012 Kriheli
8,277,424 B2 10/2012 Pan
8,317,741 B2 11/2012 Kraushaar
8,317,743 B2 11/2012 Denenburg
8,398,607 B2 3/2013 Fangrow, Jr.
8,403,905 B2 3/2013 Yow
8,425,487 B2 4/2013 Beiriger et al.
8,449,521 B2 5/2013 Thorne, Jr. et al.
8,454,579 B2 6/2013 Fangrow, Jr.
8,968,271 B2 * 3/2015 Guala ..... A61M 39/1011 604/905
9,724,269 B2 * 8/2017 Sjogren ..... A61J 1/2096
2003/0070726 A1 4/2003 Andreasson et al.
2005/0065495 A1 3/2005 Zambaux
2005/0182383 A1 8/2005 Wallen
2005/0215976 A1 9/2005 Wallen
2006/0089593 A1 * 4/2006 Landau ..... A61M 5/30 604/68
2006/0178638 A1 8/2006 Reynolds
2007/0079894 A1 4/2007 Kraus et al.
2008/0045919 A1 2/2008 Jakob et al.
2008/0287914 A1 11/2008 Wyatt et al.
2009/0159485 A1 6/2009 Jakob et al.
2010/0168638 A1 7/2010 Korogi et al.
2010/0179506 A1 7/2010 Shemesh et al.
2010/0217226 A1 8/2010 Shemesh
2011/0004183 A1 1/2011 Carrez et al.
2011/0062703 A1 3/2011 Lopez et al.
2011/0074148 A1 3/2011 Imai
2011/0106046 A1 5/2011 Hiranuma et al.
2011/0257621 A1 10/2011 Fangrow
2011/0291406 A1 12/2011 Kraft et al.
2012/0035580 A1 2/2012 Fangrow
2012/0046636 A1 2/2012 Kriheli
2012/0123381 A1 5/2012 Kraus et al.
2012/0192968 A1 8/2012 Bonnal et al.
2012/0192976 A1 8/2012 Rahimy et al.
2012/0203193 A1 8/2012 Rogers
2012/0265163 A1 10/2012 Cheng et al.
2012/0279884 A1 11/2012 Tennican et al.
2012/0316536 A1 12/2012 Carrez et al.
2013/0006211 A1 1/2013 Takemoto
2013/0012908 A1 1/2013 Yeung
2013/0066293 A1 * 3/2013 Garfield ..... A61J 1/2055 604/408
2013/0072893 A1 3/2013 Takemoto
2013/0076019 A1 * 3/2013 Takemoto ..... A61J 1/2096 285/117
2013/0079744 A1 3/2013 Okiyama et al.
2014/0150925 A1 * 6/2014 Sjogren ..... A61J 1/2096 141/94
2015/0297454 A1 * 10/2015 Sanders ..... A61J 1/2096 604/414
2015/0297459 A1 * 10/2015 Sanders ..... A61J 1/2096 604/414
2015/0297839 A1 * 10/2015 Sanders ..... A61J 1/2096 604/241
2015/0297881 A1 * 10/2015 Sanders ..... A61J 1/2096 604/535
2016/0361504 A1 * 12/2016 Kim ..... A61J 1/2096

FOREIGN PATENT DOCUMENTS

WO 2005011781 A1 2/2005
WO 2006058435 A2 6/2006
WO 2006103074 A1 10/2006
WO 2009024807 A1 2/2009
WO 2009090627 A1 7/2009
WO 2011050333 A1 4/2011
WO 2011150037 A1 12/2011

(56) References Cited

FOREIGN PATENT DOCUMENTS

| | | | |
|---|---|---|---|
| WO | 2012069401 | A1 | 5/2012 |
| WO | 2012119225 | A1 | 9/2012 |
| WO | 2012168235 | A1 | 12/2012 |
| WO | 2013025946 | A1 | 2/2013 |
| WO | 2013054323 | A1 | 4/2013 |
| WO | 2013066779 | A1 | 5/2013 |
| WO | 2013115730 | A1 | 8/2013 |
| WO | 2013179596 | A1 | 12/2013 |
| WO | 2014122643 | A1 | 8/2014 |
| WO | 2014181320 | A1 | 11/2014 |

* cited by examiner

SYRINGE ADAPTER WITH COMPOUND MOTION DISENGAGEMENT

CROSS-REFERENCE TO RELATED APPLICATION

This application claims priority to U.S. Provisional Application Ser. No. 61/982,091, filed Apr. 21, 2014, which is hereby incorporated by reference in its entirety.

BACKGROUND OF THE INVENTION

Field of the Invention

The present invention relates to an adapter for a closed system transfer assembly that permits fluid delivery from a first fluid container to a second fluid container through the adapter. More specifically, the invention is directed an adapter with a connection arrangement for engaging and disengaging the adapter from the fluid container.

Description of Related Art

Healthcare workers, such as pharmacists and nurses, can be subject to acute and long term health risks upon repeated exposure to drugs or solvents which might escape into the air during drug preparation, drug administration, and other similar handling. This problem is particularly serious when cytotoxins, antiviral drugs, antibiotics, and radiopharmaceuticals are concerned. The health risks faced by exposure to these drugs can include the development of cancer, reproductive problems, genetic conditions, and other serious concerns. Other hazardous areas may be sample taking, such as samples concerning virus infections or the like. When performing infusions, it is often necessary to inject a drug or other medical substance into the infusion fluid, inside an infusion bag or other infusion fluid container. This is often done by means of penetrating a septum or other fluid barrier of an injection port on the infusion bag or on the infusion fluid line with a needle of a syringe filled with the medical fluid in question. However, even before this, it may be necessary to transfer the medical fluid from a vial to a syringe and then from the syringe to a secondary container. In each of these steps, staff may be exposed to the medical fluid by means of contamination. Such contamination may be vaporized medical fluid or aerosol in the air. The contaminations may contaminate the staff through their lungs, or by vaporized medical fluid or aerosol in the air which condensates on the skin to thereafter penetrate the skin of the staff. Some medicaments are even known to penetrate protection gloves and thereby contaminate the staff.

Exposure to contaminations like this may, on a long term basis, give rise to alarmingly high concentrations of medicaments in the blood or the human body of the staff as described above. It has been understood that, due to the many transferring steps between e.g., vials, syringes, infusion systems, etc., the risk for contamination during the actual insertion and retraction of a needle from the container, e.g., a vial, needs to be contained. Closed system transfer devices (CSTD) have been developed to ensure that the medicament is contained in the transfer device during transfer of the medicament.

Generally, a CSTD includes an adapter (referred to hereinafter as a syringe adapter) for connection to a first fluid container, such as a syringe, and a second adapter (referred to hereinafter as a vial adapter) for connection to a vial, a second syringe, or a conduit providing fluid access to the patient's circulatory system. According to one arrangement, the healthcare practitioner may reconstitute a powdered or lyophilized compound with saline or some other reconstitution medium by attaching the syringe to the vial through the syringe adapter and the vial adapter. The practitioner reconstitutes the drug, aspirates the compound into the syringe, disconnects the adapters, and then attaches the syringe adapter and syringe attached thereto to a patient delivery device, such as an IV line or syringe, for administration to the patient.

One type of syringe adapter that can be used in a CSTD has a proximal end with a male or female luer-lock element that is arranged to be joined with a corresponding female or male luer-lock element of the syringe. The luer-lock element can be screwed into and unscrewed from the corresponding luer-lock element. It is desirable to prevent accidental or inadvertent unscrewing of the components, which could lead to the disconnection of the fluid passageway extending through the adapter. Such disconnection may result in a serious contamination risk for a patient and/or any other person in the vicinity of the disconnected CSTD. The issue of safety in administration of hazardous medical compounds is one that has been identified as being of critical importance by professional organizations and government agencies alike.

It is, therefore, desirable to provide a syringe adapter for enabling fluid transfer from the syringe to the syringe adapter, vial adapter, and second fluid container by facilitating a positive connection of the connectors and avoiding inadvertent or accidental disconnection of the syringe and fluid connector. Specifically, it is desirable that the syringe and syringe adapter may be connected together via a simple intuitive connection activity. However, the steps for disconnecting the syringe from the syringe adapter should be more complex so that inadvertent or accidental disconnection is discouraged.

SUMMARY OF THE INVENTION

In one aspect of the present invention, an adapter for connection with a fluid container includes an outer housing having a distal end, a proximal end, and a generally cylindrical sidewall extending between the distal end and the proximal end, an inner member comprising a body rotatably inserted within the outer housing and a connector extending from the body configured to connect the adapter to a fluid container, a first locking arrangement engageable with the body of the inner member and configured to restrict the inner member from rotating relative to the housing in a first direction, and a second locking arrangement engageable with the body of the inner member and configured to restrict the inner member from rotating relative to the housing in both the first direction and a second direction. The adapter is transitionable between: a disengaged state, in which the first locking arrangement and the second locking arrangement are not engaged with the inner member; a partially engaged state in which the first locking arrangement engages the inner member; and a fully engaged state in which the second locking arrangement engages the inner member.

The inner member may be rotatable in both the first direction and the second direction when the connector is in the disengaged state. The inner member may be transitionable from an extended position to a recessed position by applying a compressive force to the inner member.

The adapter may further include a biasing member that maintains the inner member in the extended position. The biasing member may be a leaf spring.

The first locking arrangement may include at least one protrusion extending inward from an inner surface of the sidewall of the housing and a corresponding protrusion on the body of the inner member configured to engage the protrusion on the sidewall. The at least one protrusion may extend inward from an inner surface of the sidewall of the housing and the corresponding protrusion on the body of the inner member may be one-way ratchets comprising a sloped face and a substantially vertical face.

The first locking arrangement may be at least two protrusions positioned on opposing circumferential sides of the sidewall of the housing and at least two corresponding protrusions extending from the body of the inner member. The second locking arrangement may be at least one inwardly extending tab connected to a portion of the sidewall of the housing and configured to selectively engage a portion of the inner member. The second locking arrangement may be at least two inwardly extending tabs positioned on opposing sides of the sidewall of the housing. The at least one tab may be a pressing surface configured such that applying a compressive force to the pressing surface biases the tab inward to engage the portion of the inner member. The tab may be connected to the sidewall of the housing at a flexible joint, such that application of the compressive force to the pressing surface biases the tab inward about the flexible joint. The second locking arrangement may include a beam that connects the tab to the sidewall of the housing, and where applying a compressive force to the pressing surface deflects the beam inward thereby extending the at least one tab toward the inner member. The second locking arrangement may include two beams connected to opposing sides of the tab. The second locking arrangement may include at least one tooth extending radially from the inner member, with the tooth being configured to engage the at least one tab.

The connector may include an outer surface with helical threads configured to engage corresponding threads on an inner surface of a portion of the fluid container. The connector may be a luer connector configured to receive a corresponding luer connector of the fluid container.

The inner member may be transitionable from an extended position to a recessed position relative to the outer member, where the inner member is in the disengaged state when in the extended position, and where the inner member is in one of the partially engaged state and the fully engaged state when in the recessed position. The inner member may be in the fully engaged state when the inner member is in the recessed position and when the second locking arrangement is engaged with the body of the inner member.

In a further aspect of the present invention, a method of disconnecting a fluid container to an adapter includes: providing an adapter comprising an outer housing having a distal end, a proximal end, and a generally cylindrical sidewall extending between the distal end and the proximal end, an inner member comprising a body rotatably inserted within the housing and a connector extending from the body comprising a connector configured to engage with the fluid container, a first locking arrangement engageable with the body of the inner member and configured to restrict the inner member from rotating relative to the housing in a first direction, and a second locking arrangement engageable with the body of the inner member and configured to restrict the inner member from rotating relative to the housing in both the first direction and a second direction; moving the fluid container in an axial direction towards the adapter; engaging the second locking arrangement; and rotating the fluid container to disconnect the fluid container from the inner member of the adapter.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE INVENTION

Figure 1:
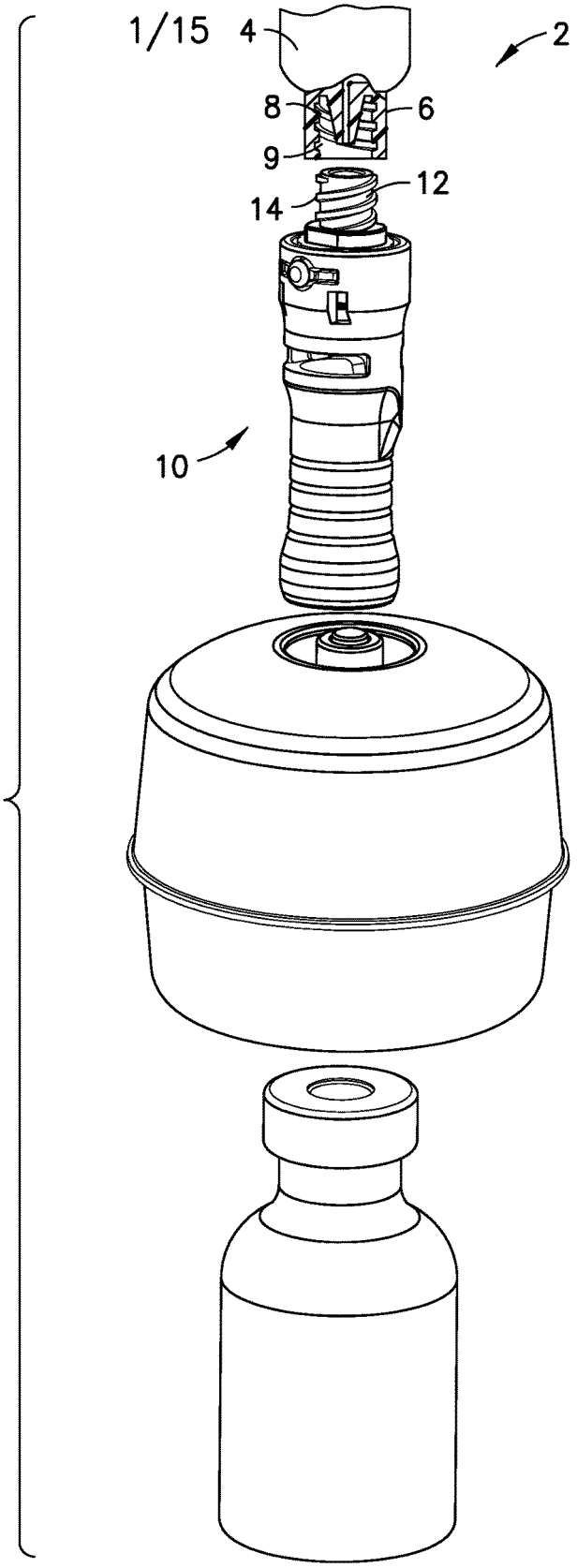
FIG. 1 is a perspective view of closed system transfer device system according to an aspect of the invention.

The illustrations generally show preferred and non-limiting aspects of the systems and methods of the present disclosure. While the descriptions present various aspects of the devices, it should not be interpreted in any way as limiting the disclosure. Furthermore, modifications, concepts, and applications of the disclosure's aspects are to be interpreted by those skilled in the art as being encompassed by, but not limited to, the illustrations and descriptions herein.

Further, for purposes of the description hereinafter, the terms "end", "upper", "lower", "right", "left", "vertical", "horizontal", "top", "bottom", "lateral", "longitudinal", and derivatives thereof shall relate to the disclosure as it is oriented in the drawing figures. The term "proximal" refers to the direction toward the center or central region of the device. The term "distal" refers to the outward direction extending away from the central region of the device. However, it is to be understood that the disclosure may assume various alternative variations and step sequences, except where expressly specified to the contrary. It is also to be understood that the specific devices and processes illustrated in the attached drawings, and described in the following specification, are simply exemplary aspects of the disclosure. Hence, specific dimensions and other physical characteristics related to the aspects disclosed herein are not to be considered as limiting. For the purpose of facilitating understanding of the disclosure, the accompanying drawings and description illustrate preferred aspects thereof, from which the disclosure, various aspects of its structures, construction and method of operation, and many advantages may be understood and appreciated.

With reference to FIG. 1, a closed system transfer assembly 2 is illustrated. The closed system transfer assembly 2 includes a first fluid source or container, such as a syringe 4 or IV line, configured to be connected to a syringe adapter (referred to hereinafter as adapter 10). The syringe 4 includes a male luer connector 6 that is configured to be secured to a corresponding female luer-lock connector 12 of the adapter 10. However, it is understood that the arrangement of the male and female luer-lock fittings may be reversed for certain fluid delivery applications. Any other connection interface, as is known in the art, may also be added in place of the luer fittings as required. The distal end of the syringe 4 may also include a luer-lock 8 surrounding the male luer connector 6 with threads 9 configured to engage corresponding threads 14 surrounding the connector 12. More specifically, the adapter 10 is an assembly of components adapted to create a tamper-proof connection interface with the syringe 4. The adapter 10 is configured to prevent accidental or inadvertent disconnection of the adapter 10 and the syringe 4, which could compromise the integrity of the closed system transfer assembly 2. As will be described in detail hereinafter, the adapter 10 includes various locking arrangements for preventing a user from inadvertently disengaging the adapter 10 from the syringe 4. As a result of the locking arrangements, to disengage the syringe 4 from the adapter 10, the user must perform a compound motion activity. As referred to hereinafter, a compound motion activity refers to more than one distinct and independent motion performed in a predetermined order or sequence. For example, in one aspect of the adapter 10, the compound motion activity includes at least three distinct motions, namely pressing the syringe 4 toward the adapter 10, pressing a button, tab, or surface located on a sidewall of the adapter 10, and rotating the syringe 4 relative to the adapter 10 to disengage the threads 14 of the connector 10 from the threads 9 on the luer-lock 8 of the syringe 4. The sequence of predetermined steps may also be reversed or performed in a different order within the scope of the present invention.

Figure 2:
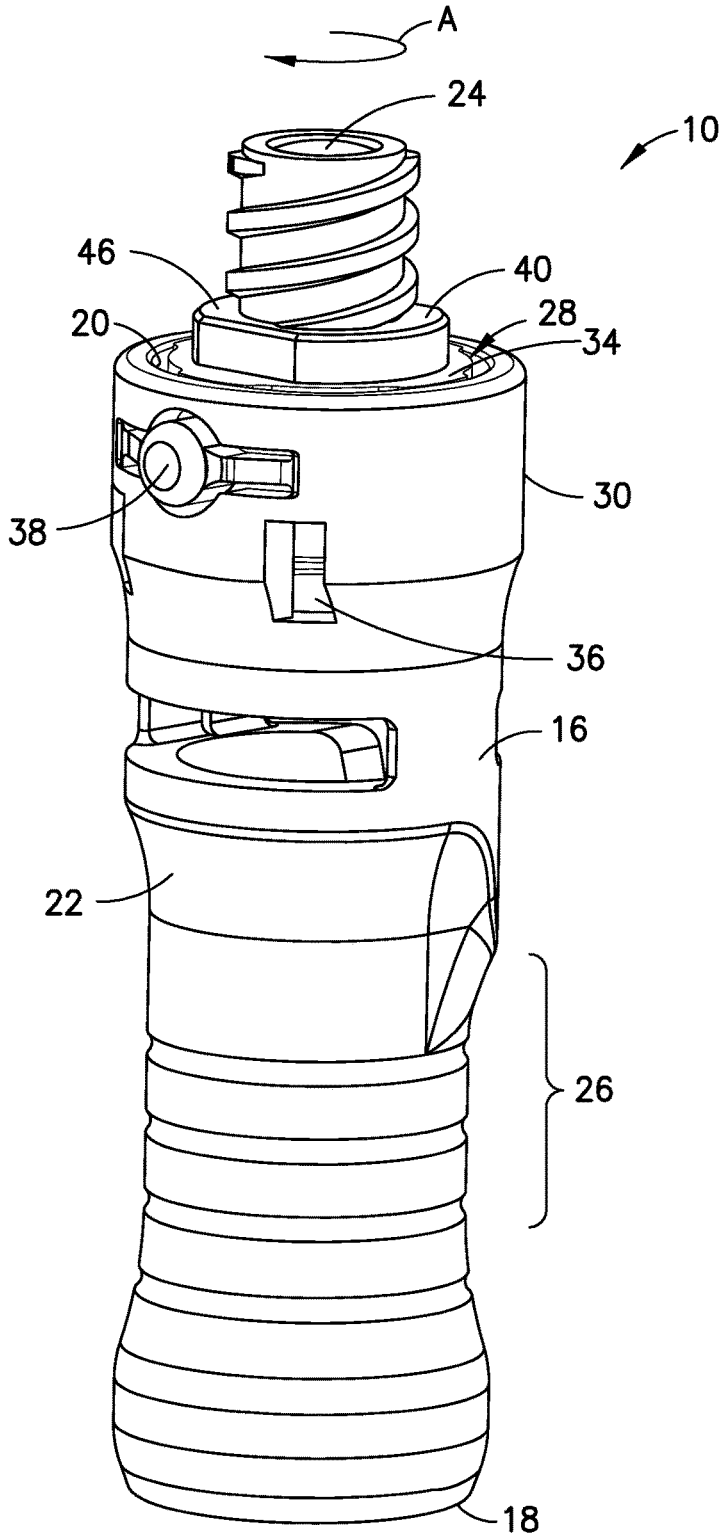
FIG. 2 is a perspective view of an adapter according to an aspect of the invention.
Figure 3:
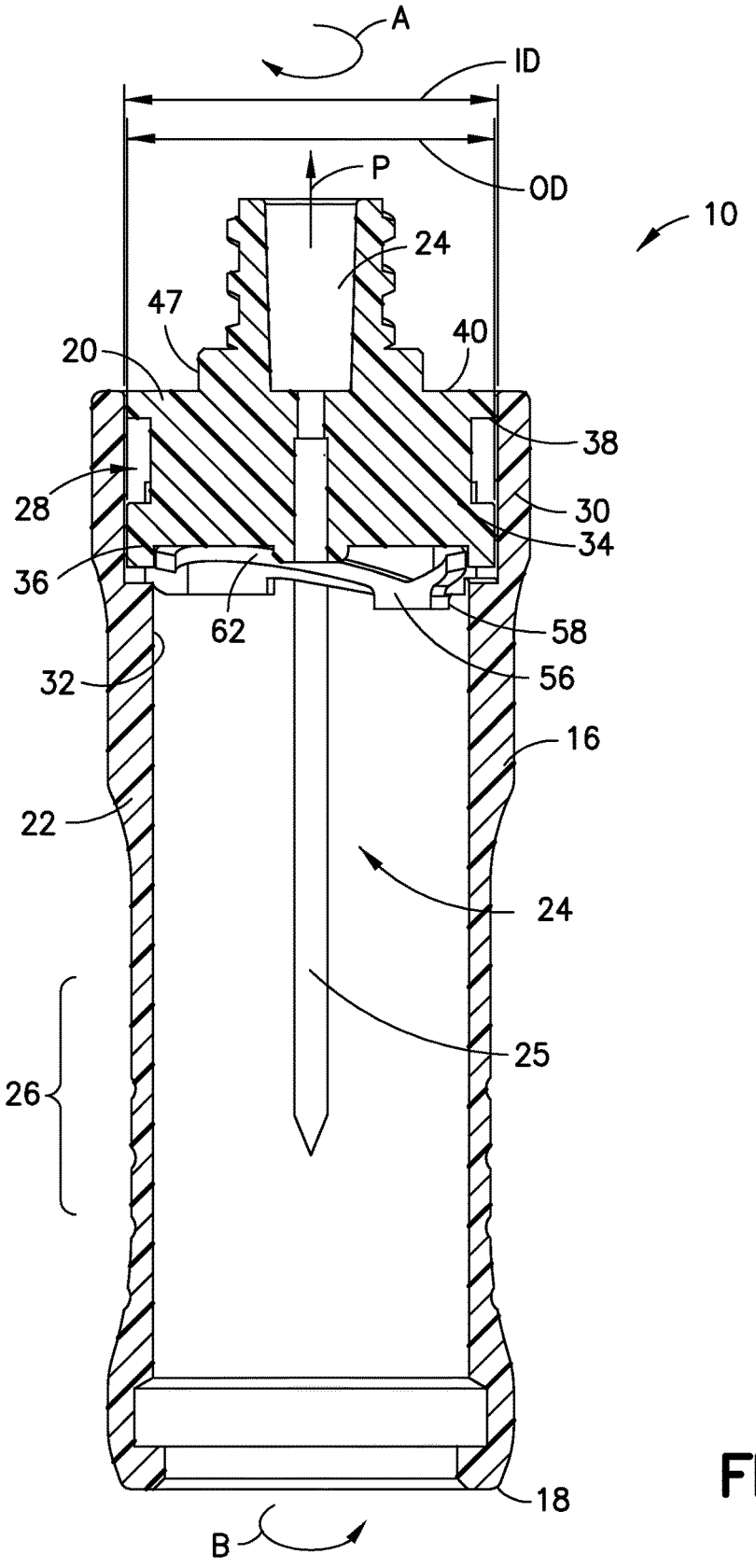
FIG. 3 is a cross sectional view of the adapter of FIG. 2.
Figure 4:
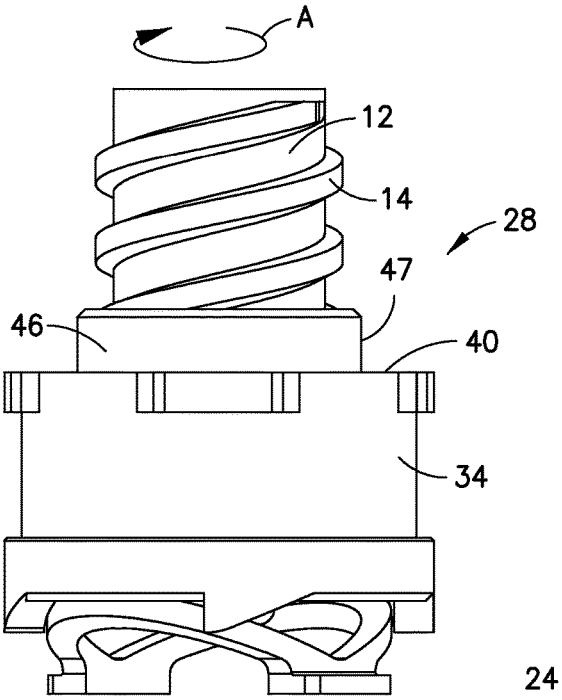
FIG. 4 is a perspective view of an inner member of the adapter of FIG. 2.
Figure 5:
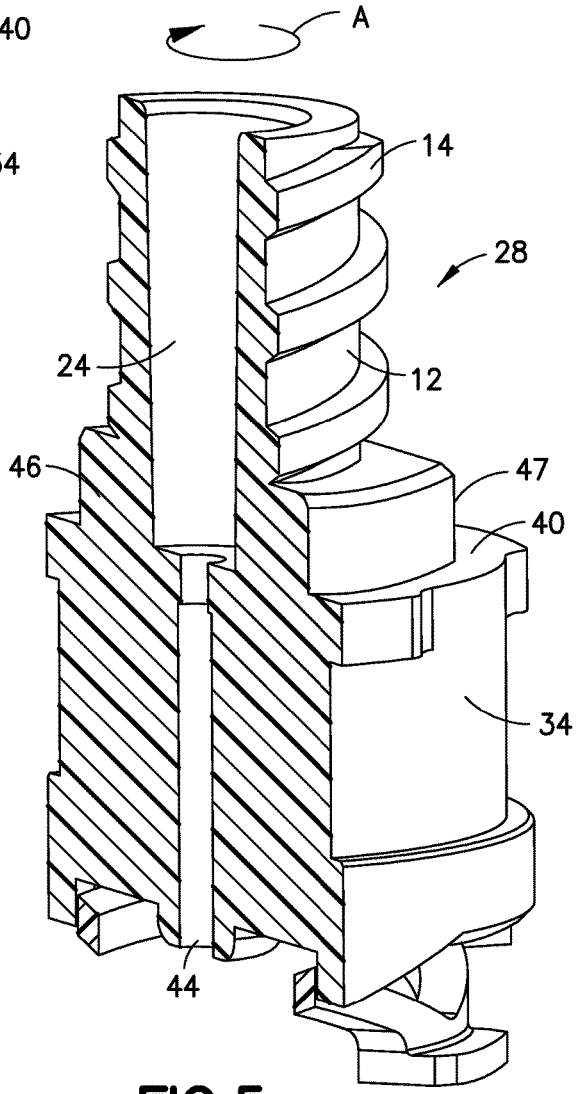
FIG. 5 is a cross sectional view of the inner member of FIG. 4.

With reference to FIGS. 2 and 3, the adapter 10 includes an outer housing 16 having a distal end 18, a proximal end 20, and a generally cylindrical sidewall 22 extending between the distal end 18 and the proximal end 20. The housing 16 defines a fluid passageway 24 (shown in FIG. 3) extending between the proximal end 20 and distal end 18 of the outer housing 16. The housing 16 may be formed from any suitable structural material including medical grade plastic or metal. Optionally, the housing 16 may include various features that make holding or manipulating the housing 16 and adapter 10 easier. For example, the housing 16 may include a narrower grip portion 26 that is more comfortable for users to hold. The housing 16 may also include a textured portion or surface (not shown) so that the housing 16 does not slip or slide when held by the user. The housing 16 may also include various aesthetic features such as patterns, designs, logos, and the like for improving the appearance of the outer housing 16.

With continued reference to FIGS. 2 and 3, in certain aspects, the housing 16 includes a needle cannula 25 extending therethrough that forms the fluid passageway 24. The cannula 25 may include a tip at a distal end thereof for establishing a fluid connection with a fluid container such as a medical vial. The housing may also include a septum (not shown) or seal arrangement, capable of being pierced by the tip of the needle, extending across an inner portion of the housing 16. During use, the needle tip and cannula 25 may be advanced through the septum or seal arrangement to establish fluid communication through the housing 16. The septum or seal arrangement may be configured to prevent fluid from passing through the housing 16 and contaminating other elements of the adapter 10 and/or syringe 4.

The adapter 10 further includes an inner member 28 inserted in the proximal end 20 of the housing 16. For example, in one aspect, the inner member 28 may be inserted in an annular sleeve 30 extending around the proximal end 20 of the housing 16. As will be described hereinafter, an inner surface 32 (shown in FIG. 3) of the sidewall 22 may include various structures for engaging the inner member 28 to restrict rotation thereof. The inner member 28 includes a substantially cylindrical body 34 having an outer diameter OD that generally corresponds with the inner diameter ID of the sidewall 22 of the housing 16. The adapter 10 also includes a first locking arrangement 36 that is capable of engaging with the body 34 of the inner member 28 for restricting the inner member 28 from turning in a first direction A, such as clockwise, and a second locking arrangement 38 that is capable of engaging with body 34 of the inner member 28 for restricting the inner member 28 from turning in both the first direction A and a second direction B, such as counter clockwise.

As will be described in greater detail hereinafter, the adapter 10 is transitionable between three states or positions. First, the adapter 10 may be in a disengaged state, in which the first locking arrangement 36 and the second locking arrangement 38 are not engaged with the inner member 28. In the disengaged state, the inner member 28 can freely rotate relative to the stationary outer housing 16 in both the first direction A and the second direction B. Second, the adapter 10 may be in a partially engaged state. In the partially engaged state, the first locking arrangement engages 36 the inner member 28 so that rotation in direction A is substantially prevented. Finally, the adapter 10 may be transitioned to a fully engaged state or position in which the second locking arrangement 38 engages the inner member 28, thereby preventing the inner member 28 from rotating substantially freely in either the first direction A or the second direction B. It is noted, however, that some rotation may still occur in the partially engaged and fully engaged states if the locking arrangements 36, 38 have not reached a hard stop or if the user is not gripping the locking arrangements 36, 38 strongly enough to fully prevent rotation of the inner member 28.

With reference to FIGS. 2-5, the body 34 of the inner member 28 is a substantially cylindrical structure, although other suitable shapes may be utilized. The body 34 may include a cap 40 or top on a proximal end thereof. The cap 40 covers a portion of the proximal end of the body 34 and, when inserted in the housing 16, also covers at least a portion of the proximal end 20 of the housing 16. The connector 12 extends from the cap 40 of the body 34 and is positioned such that the fluid passageway 24 extends therethrough. For example, a proximal end of the cannula 25 (shown in FIG. 3) may be inserted into a distal end 44 (shown in FIG. 5) of the connector 12 for permitting fluid flow through the housing 16 of the adapter 10.

The connector 12 includes various structures for connecting the inner member 28 of the adapter 10 to the syringe 4 (shown in FIG. 1). As described above, in one aspect, the exterior sidewall of the connector 12 includes helical threads 14 extending therefrom. The threads 14 are configured to engage corresponding threads 9 on the syringe 4 (shown in FIG. 1). For example, the user may connect the syringe 4 to the connector 10 by twisting the syringe 4 in a direction A.

In certain aspects, the inner member 28 also includes a pedestal 46 or base located between the body 34 of the inner member 28 and the connector 12. The pedestal 46 includes at least one flat 47. For example, the pedestal 46 may include opposing flats 47 on either side of the pedestal 46. As will be described hereinafter, the flats 47 are configured to be connected with a removal tool 100 (shown in FIG. 17), such as a wrench. The removal tool 100 prevents the inner member 28 from rotating relative to the housing 16, making it easier to remove the syringe 4 from the adapter 10.

Figure 7:
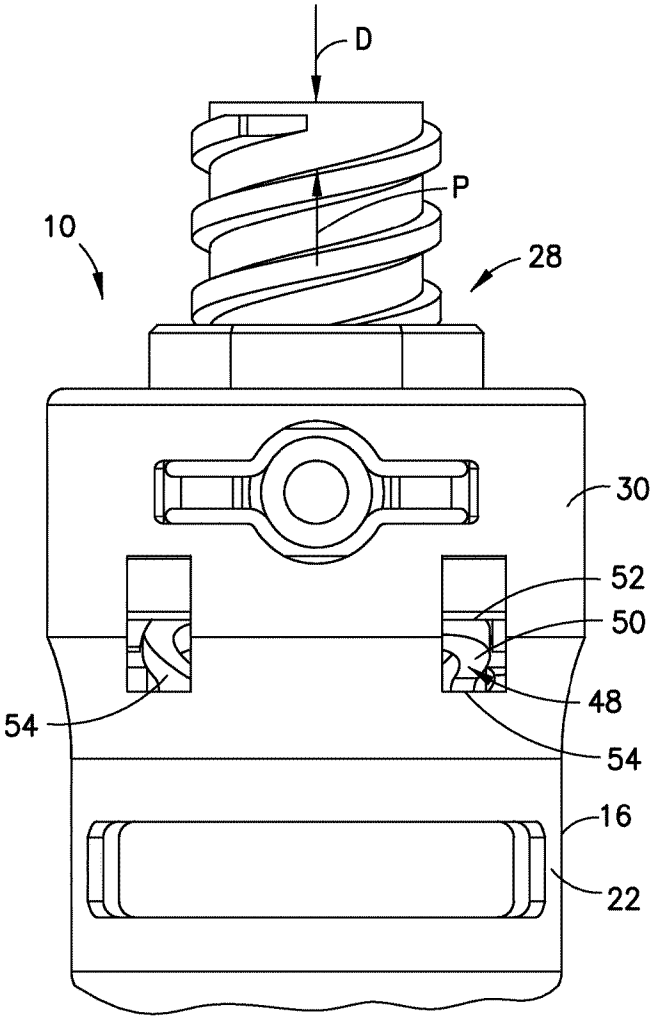
FIG. 7 is a front view of a portion of the adapter of FIG. 2.

With reference to FIG. 7 and as described above, the inner member 28 is configured to be inserted in the proximal end 20 of the housing 16 of the adapter 10. Optionally, the housing 16 may include structures for maintaining the inner member 28 in the housing 16. For example, the adapter 10 may include a snap fit mechanism 48 configured to engage a portion of the inner member 28. The snap fit mechanism 48 may include a ledge 50 or ring extending from a portion of the sidewall 22 of the housing 16. A corresponding ledge 52 or ring on the body 34 of the inner member 28 is configured to contact the ledge 50 or ring for maintaining the inner member 28 in the housing 16. In certain aspects, a window 54 on the sidewall 22 of the housing 16 allows the user to determine when the snap fit connection is established.

Figure 6A:
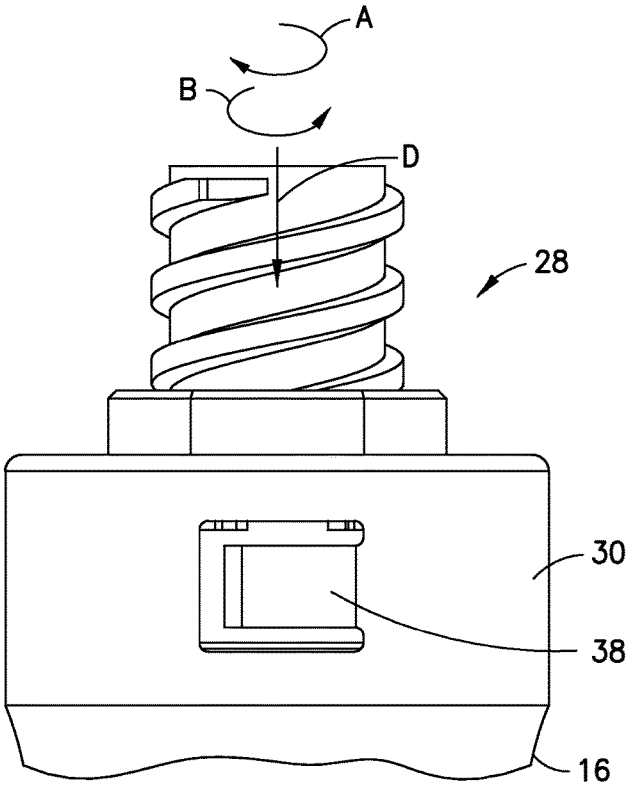
FIG. 6A is a front view of a portion of an adapter having an inner member in an extended position, according to another aspect of the invention.
Figure 6B:
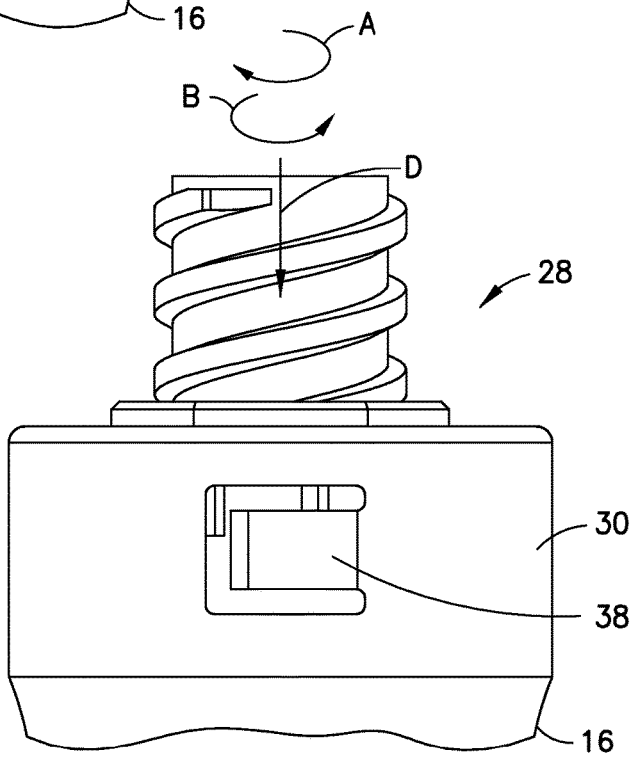
FIG. 6B is a front view of the adapter of FIG. 6A with the inner member in the recessed position.

With reference to FIGS. 6A and 6B, the inner member 28 is configured to be transitionable from an extended position (shown in FIG. 6A) to a recessed position (shown in FIG. 6B) in which the inner member 28 is inserted farther into the outer housing 16. The user advances the inner member 28 in the distal direction D, relative to the housing 16, to transition the inner member 28 from the extended position to the recessed position by applying a compressive force thereto. As will be described hereinafter, the first locking arrangement 36 (shown in FIGS. 2 and 3) and second locking arrangement 38 cannot engage the inner member 28 when it is in the extended position. When the inner member 28 is in the recessed position, the first locking arrangement 36 and/or second locking arrangement 38 are capable of engaging the inner member 28 to restrict rotation of the inner member 28 relative to the outer housing 16 in the first direction A and/or in the second direction B.

Figure 8:
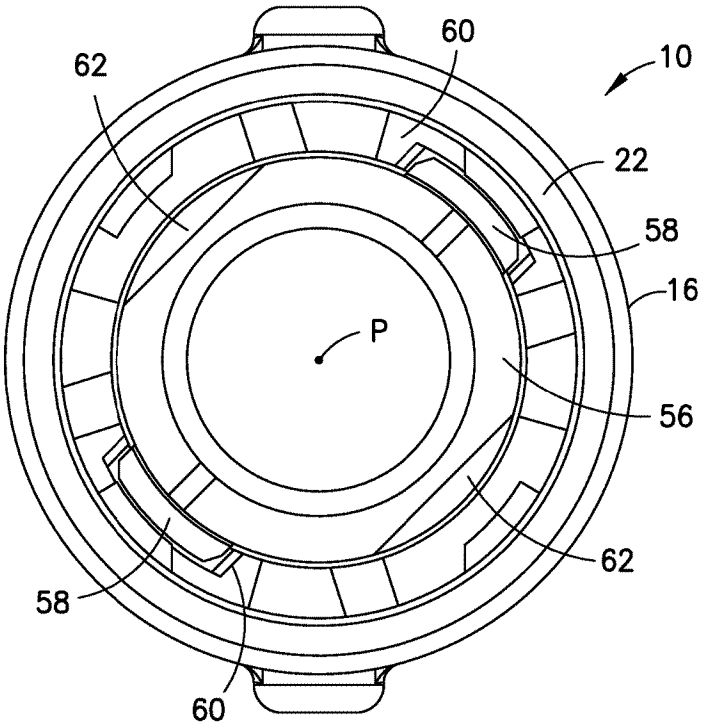
FIG. 8 is a top view of the adapter of FIG. 2 with the inner member removed therefrom.
Figure 9A:
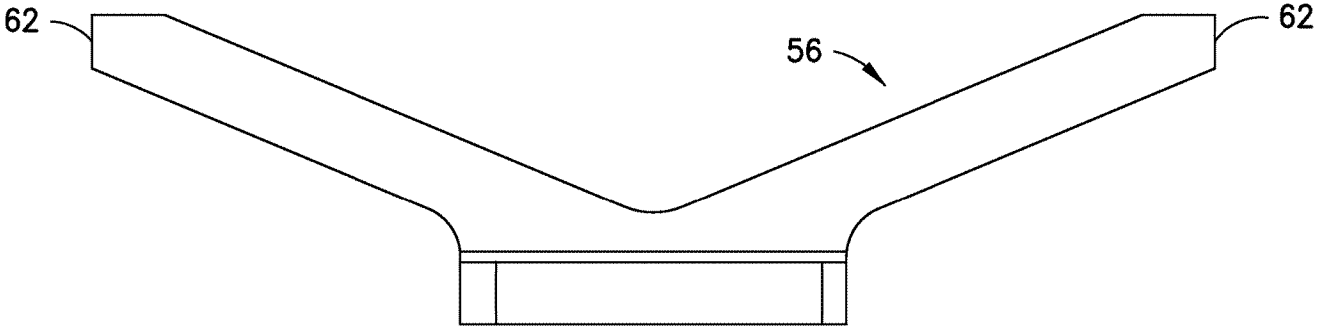
FIG. 9A is a front view of the leaf spring of the adapter of FIG. 2 in a default position.
Figure 9B:
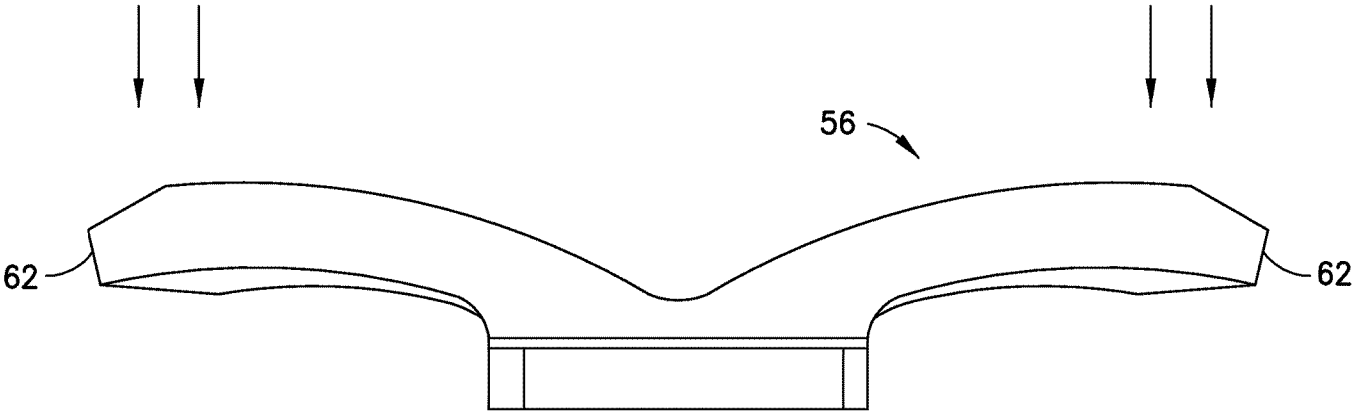
FIG. 9B is a front view of the leaf spring of FIG. 9A in a compressed position.

With reference to FIGS. 3 and 8, the adapter 10 may further include a biasing member, such as a leaf spring 56, connected between the housing 16 and inner member 28 (shown in FIG. 3). The leaf spring 56 includes two or more flexible arms 62 that may be moved from a default position (shown in FIG. 9A) to a compressed position (shown in FIG. 9B). In certain aspects, the leaf spring 56 is a single molded structure. The leaf spring 56 may also be molded as two or more separate components connected together through the inner member 28. The leaf spring 56 may also be integrally formed with the inner member 28. As will be appreciated by one having ordinary skill in the art, the outer diameter of the ring formed by the flexible arms 62 increases as the spring 56 is compressed from the default position to the compressed position. In other aspects, the leaf spring 56 may also be configured with a constant outer diameter in both the default and compressed positions. The leaf spring 56 may include a bottom 58 or foot configured to be received within a groove 60 (shown in FIG. 8) extending from a portion of the sidewall 22 of the housing 16. With specific reference to FIG. 3, the leaf spring 56 is configured to bias the inner member 28 in the proximal direction P relative to the outer housing 16 to counteract compressive force applied to the inner member 28 by the user. Accordingly, when compressive force is not applied to the inner member 28, the leaf spring 56 maintains the inner member 28 in the extended position. As previously described, when the inner member 28 is in the extended position, the first locking arrangement 36 and the second locking arrangement 38 cannot engage the inner member 28. Thus, the inner member 28 is freely rotatable in both direction A and direction B. The user may transition the inner member 28 to the recessed position by applying a compressive force thereto in the distal direction D that is sufficient to overcome the biasing force of the leaf spring 56.

As described above, the adapter 10 of the present disclosure is configured to require a compound motion or activity to disconnect the syringe 4 (shown in FIG. 1) from the adapter 10. In a preferred and non-limiting aspect of the adapter 10, the first activation motion or maneuver is considered to be pressing the inner member 28 in the distal direction D with a compressive force that is sufficient to counteract the biasing force of the leaf spring 56. This activity may be performed, for example, when pressing the male luer-lock 6 (shown in FIG. 1) into the corresponding female luer-lock fitting of the connector 12.

Figure 10:
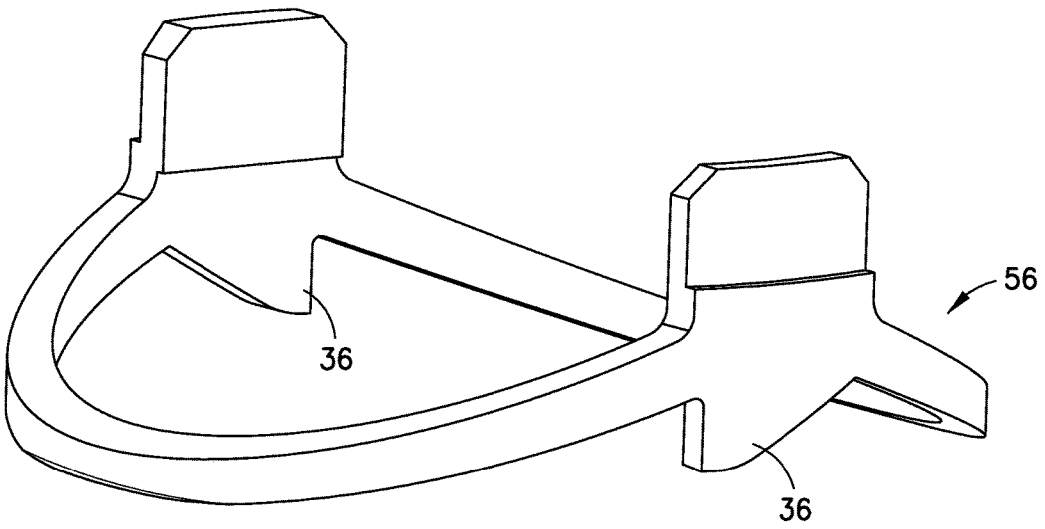
FIG. 10 is a perspective view of a biasing member according to another aspect of the invention.
Figure 11:
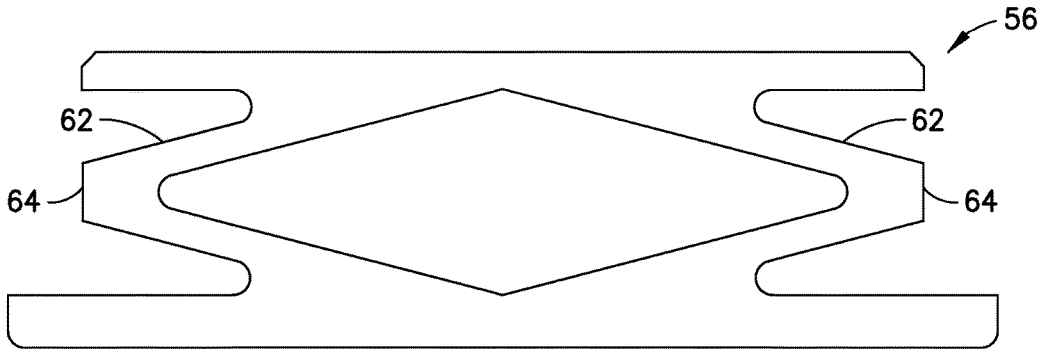
FIG. 11 is a perspective view of a biasing member according to another aspect of the invention.

With reference to FIGS. 10 and 11 alternative aspects of leaf springs 56 are illustrated. Specifically, in FIG. 10, the leaf spring 56 includes a portion of the first locking arrangement 36. In that case, the body 34 of the inner member 28 can be a monolithic piece that can be used in a variety of applications, regardless of the structure of the first locking arrangement 36. As will be described hereinafter, the first locking arrangement 36 interacts with a corresponding portion of the sidewall 22 of the housing 16 to limit rotation of the inner member 28. In FIG. 11, an aspect of the leaf spring 56 with opposing flexible joints 64 connecting the flexible arms 62 together is illustrated. The flexible joints 64 ensure that the spring 56 can transition to the compressed position without substantially increasing the diameter of the spring 56.

Having generally described the structure of aspects of the outer housing 16, inner member 28, and leaf spring 56 of the adapter 10, the structure of the first locking arrangement 36 and the second locking arrangement 38, which restrict rotation of the inner member 28 in the first direction A and/or the second direction B, will now be discussed.

Figure 12:
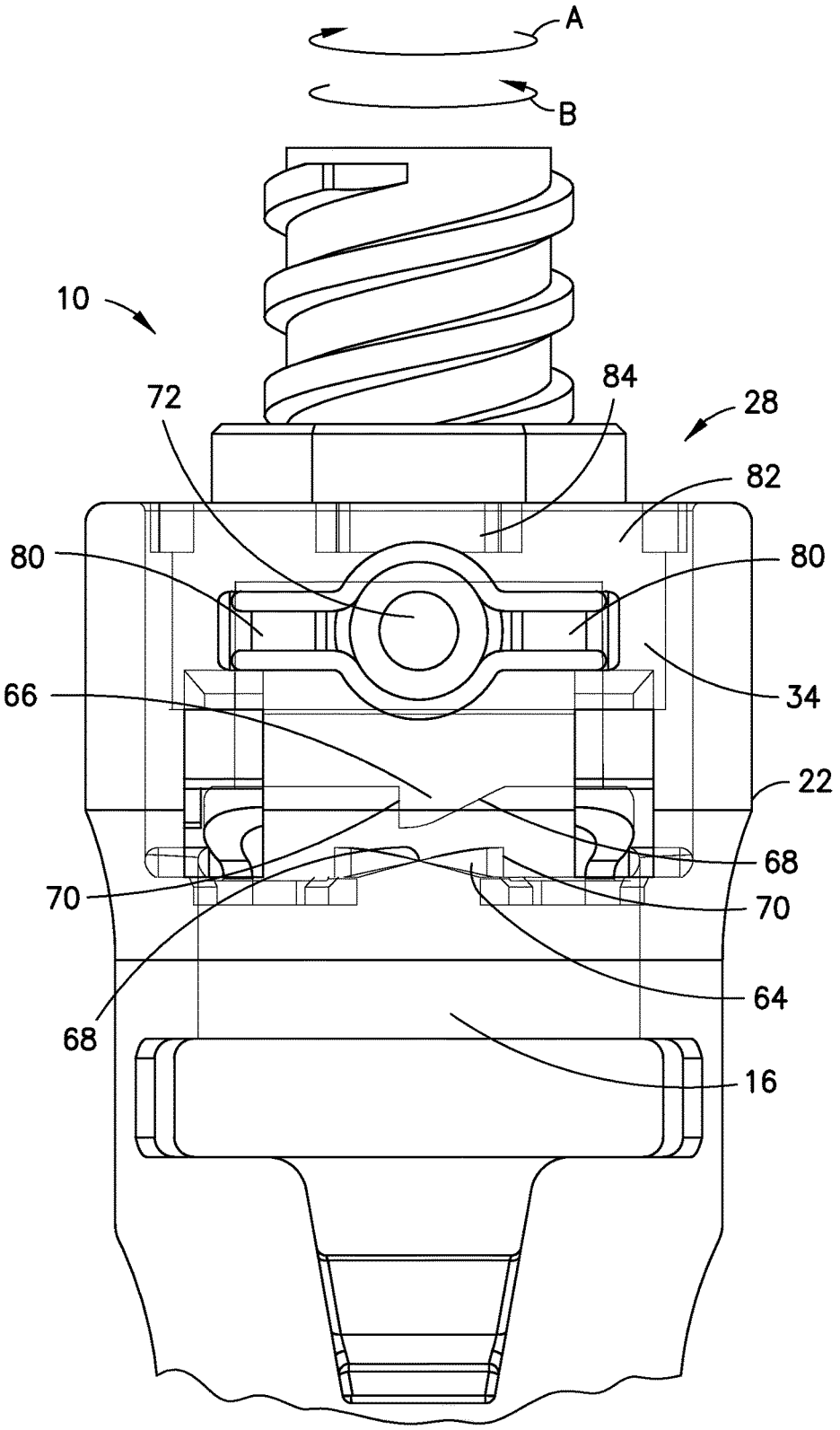
FIG. 12 is a front view of a portion of the adapter of FIG. 2 with the exterior of the adapter housing being transparent for clarity.

With reference to FIGS. 3 and 12, as described hereinabove, when the inner member 28 is in the recessed position, the first locking arrangement 36 is capable of engaging a portion of the body 34 of the inner member 28, thereby preventing the user from rotating the inner member 28 in the first direction A, but permitting rotation in the second direction B. With specific reference to FIG. 12, in certain aspects, the first locking arrangement 36 includes at least one protrusion 64 extending inward from the inner surface of the sidewall 22 of the housing 16. A corresponding protrusion 66 on the body 34 of the inner member 28 is configured to contact the protrusion 64 on the sidewall of the housing 16 when the inner member 28 is in the recessed position. The protrusions 64, 66 may be corresponding one-way ratchet structures. For example, each protrusion 64, 66 may include a sloped face 68 and a vertical face 70. As will be appreciated by one having skill in the art, the vertical face 70 of the protrusions 64, 66 engage each other to prevent rotation of the inner member in direction A. When the inner member 28 is rotated in direction B, the sloped faces 68 of corresponding protrusions 64, 66 slide against one another to allow movement or rotation of the inner member 28.

The protrusions 66, 64 may be arranged in a variety of configurations about the circumference of the body 34 of the inner member 28 and inner surface of the sidewall 22. For example, the adapter 10 may include two protrusions 64 extending from the inner sidewall 22 of the housing 16 and two corresponding protrusions 66 on the body 34 of the inner member 28. The protrusions 64, 66 may be positioned on opposing sides of the inner member 28 and sidewall 22. The adapter 10 may also include four or more protrusions 64, 66 placed at equidistant points about the sidewall 22 and inner member 28. Furthermore, the sidewall 22 may include a different number of protrusions 64 than the inner member 28. For example, in one aspect of the inner member 28, the body 34 of the inner member 28 includes two protrusions 64 on opposing sides thereof. The sidewall 22 may include four or more protrusions 66. In this way, the user does not have to twist the inner member 28 as far before engagement between the protrusions 64, 66 is established.

Figure 13:
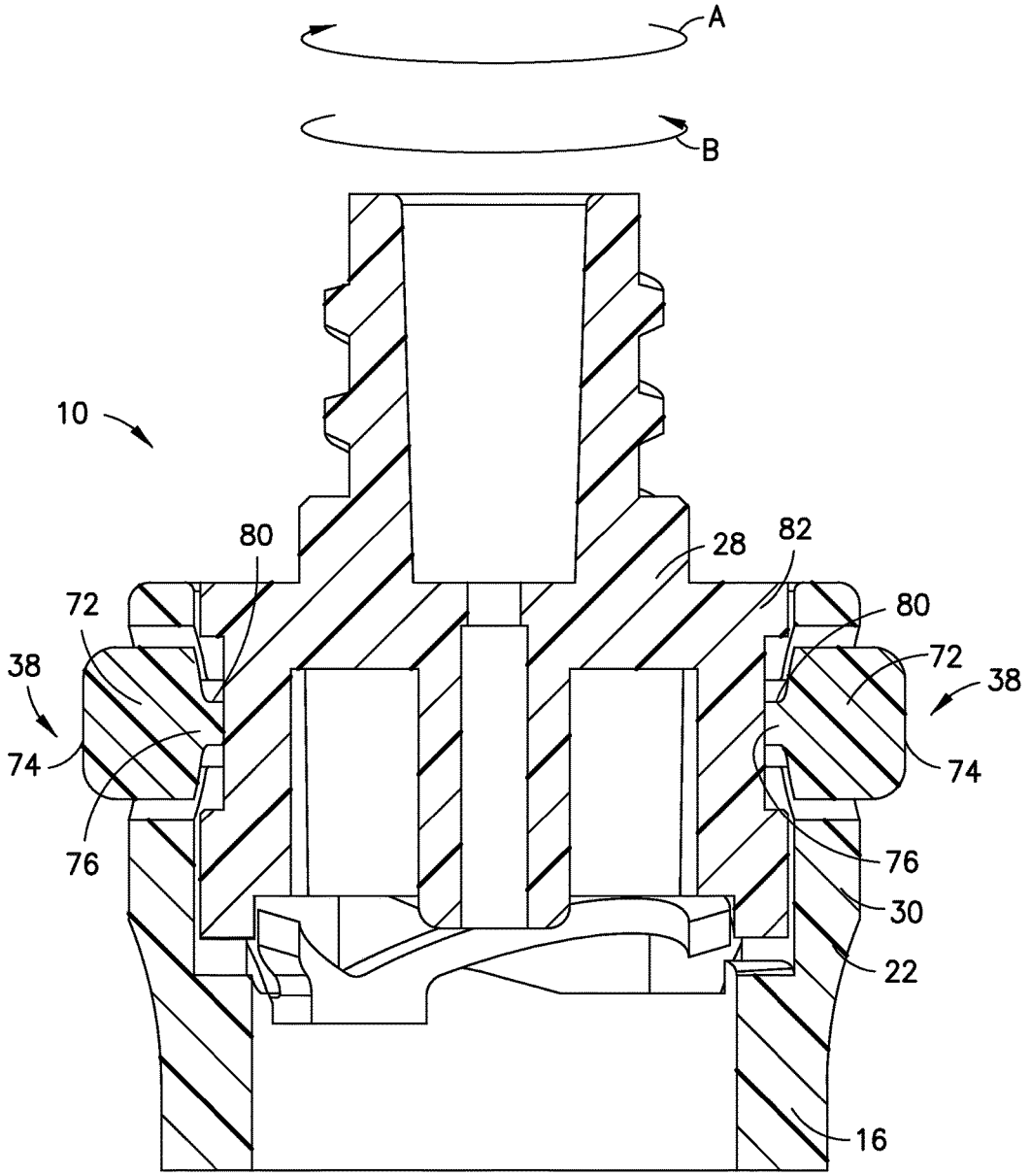
FIG. 13 is a cross section view of a portion of the adapter of FIG. 2.

With reference to FIGS. 3 and 13, when the inner member 28 is in the recessed position, the second locking arrangement 38 is capable of engaging the inner member 28 to prevent the inner member 28 from rotating in either the first direction A or the second direction B. The second locking arrangement 38 includes at least one inwardly extending tab 72 connected to a portion of the sidewall 22 of the housing 16 and configured to selectively engage a portion of the inner member 28. In certain aspects, the adapter 10 includes two or more tabs 72 on opposite sides of the housing 16. Optionally, additional tabs 72 may also be positioned around the sidewall 22 of the housing 16 to impart additional engagement force to the inner member 28 when needed for specific applications. In addition, the adapter 10 may include various fake buttons (not shown) or surfaces spaced about the adapter 10 for aesthetic purposes, such as to give the adapter 10 a more symmetrical appearance. The housing 16 may also be structured to hide the tabs 72 to make them less obvious, thereby improving the appearance of the adapter 10.

Figure 14:
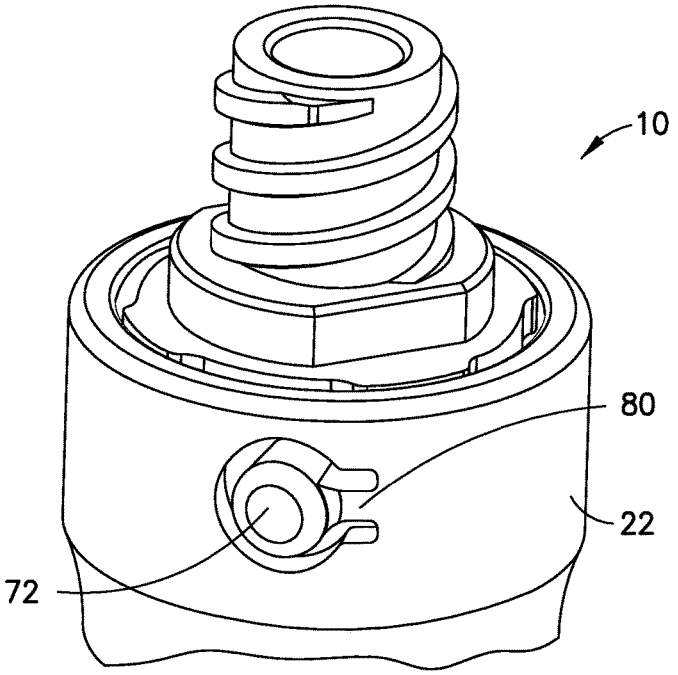
FIG. 14 is a perspective view of a portion of an adapter according to another aspect of the invention.

Each tab 72 includes a pressing surface 74, such as a button, swing arm, or tab, located on an outer side thereof, configured to be pressed by the user. The tab 72 also includes an inner surface 76 configured to contact and engage a portion of the inner member 28. The user applies a compressive force to the pressing surface 74 of each tab 72, thereby biasing the tab 72 in an inward direction toward the inner member 28. For example, in one aspect, the pressing surface 76 of the tab 72 is configured to contact a smooth surface of the body 34 of the inner member 28 to form a frictional engagement therewith. The tab 72 is connected to the sidewall 22 through one or more beams 80 connected between the tab 72 and sidewall 22. For example, the aspect of the adapter 10 illustrated in FIGS. 12 and 13 includes two beams 80 connected on opposite sides of the tab 72. The aspect of the adapter 10 illustrated in FIG. 14 includes only one beam 80 connected to the tab 72. A user may press the pressing surface 74 of the tab 72 causing the beam 80 to deflect inward and bringing an inner surface 76 of the tab 72 into contact with the inner member 28 to restrict rotation thereof.

Figure 15:
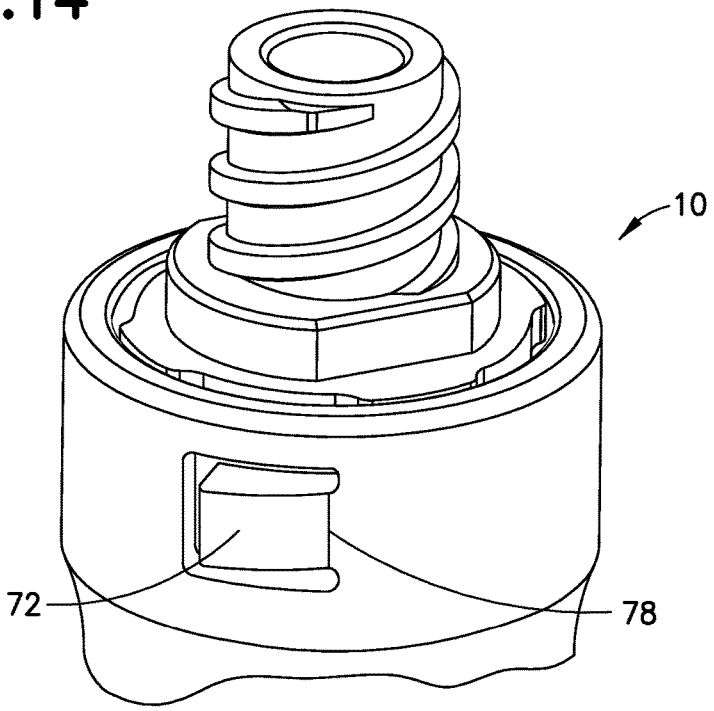
FIG. 15 is a perspective view of a portion of an adapter according to another aspect of the invention.

With reference to FIG. 15, in certain other aspects, the tab 72 may be a swing tab that is directly connected to the sidewall 22 of the housing 16 at a flexible joint 78. Applying compressive force to the tab 72 causes it to rotate inward relative to the joint 78 bringing the inner surface 76 into contact with the inner member 28.

With reference again to FIGS. 12 and 13, the inner member 28 may include various structures for strengthening, reinforcing, or optimizing the engagement between the inner surface 76 of the tab 72 and the inner member 28. For example, in one aspect, the inner member 28 includes protrusions, such as at least one radially extending tooth 82, extending from a skirt or surface 84 of the body 34. In one aspect, a number of teeth 82 may be arranged around a circumference of the surface 84 to form a ring of radially extending teeth 82. As the tab 72 is biased in an inward direction toward the inner member 28, the pressing surface 76 of the tab 72 engages the inner member 28. More specifically, the pressing surface 76 may engage the surface 84 at a region between adjacent teeth 82, thereby forming an interference engagement that restricts or prevents rotation of the inner member 28 relative to the housing 16.

Figure 16:
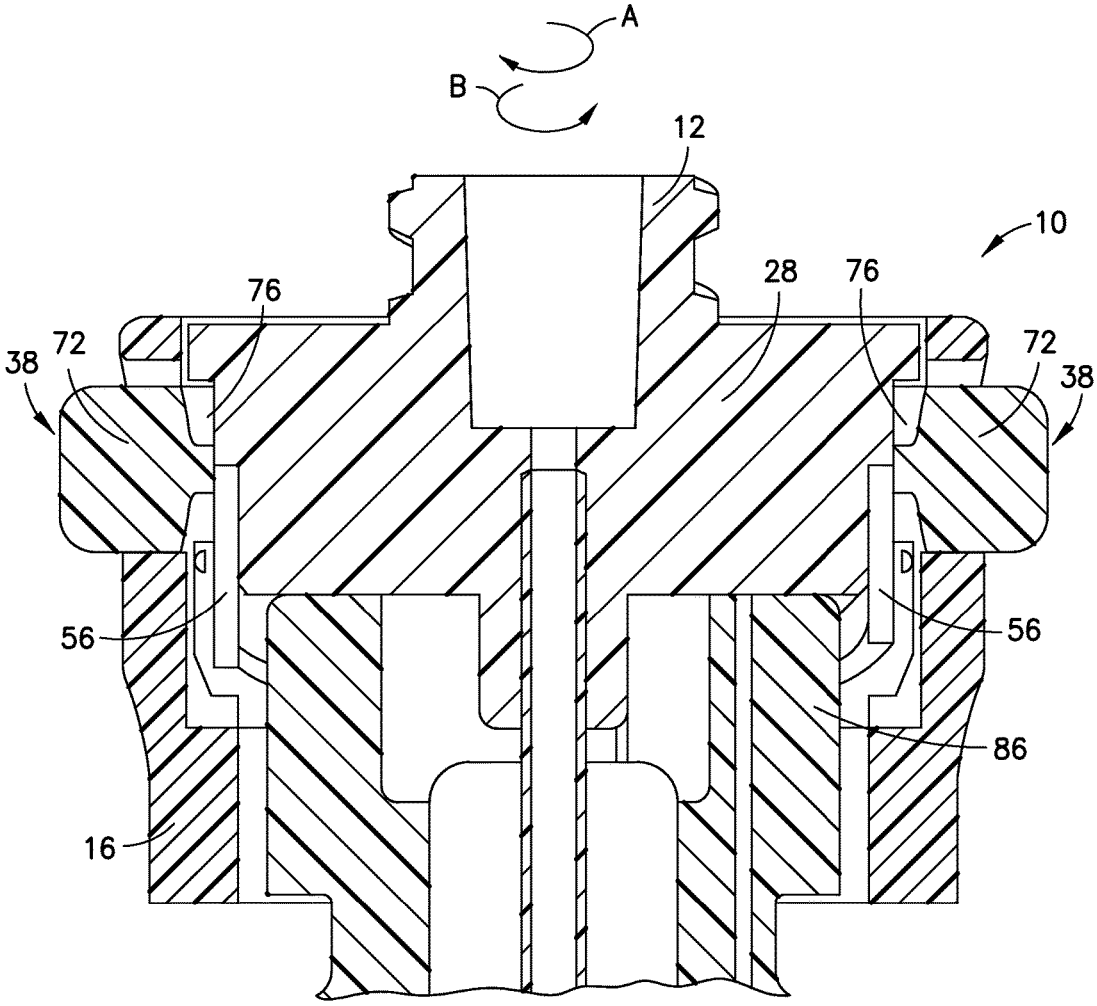
FIG. 16 is a cross section view of an adapter according to another aspect of the invention.

With reference to FIG. 16, in a preferred and non-limiting aspect, the adapter 10 further includes a membrane housing 86 inserted within the outer housing 16. The membrane housing 86 supports or holds a septum or membrane (not shown). The septum or membrane prevents fluid or gas from passing to the atmosphere through the interior of the adapter 10. The membrane housing 86 is capable of moving within the outer housing 16. In one position, such as when the adapter 10 is connected to a mating connector or component, the membrane housing 86 is adjacent to the distal end of the inner member 28 and partially surrounded by the leaf spring 56. In this position, the membrane housing 86 prevents the inner member 28 from biasing the leaf spring 56 and transitioning from the extended position to the recessed position. Accordingly, the membrane housing 86 also prevents the one-way ratchet structures of the first locking arrangement 36 (not shown in FIG. 16) or tabs 72 and pressing surfaces 76 of the second locking arrangement 38 from contacting and engaging the inner member 28 to restrict rotation thereof. Therefore, when the membrane housing 86 is adjacent to the inner member 28, the inner member 28 is held in the extended position and spins freely in direction A and direction B. As such, it would be difficult to remove the syringe 4 (shown in FIG. 1) from the connector 12 when the membrane housing 86 is in the position adjacent to the inner member 28 illustrated in FIG. 16.

Having discussed the closed transfer system assembly 2 and structure of the adapter 10, steps for connecting the syringe 4 to and disconnecting the syringe 4 from the adapter 10 will now be discussed in detail. As described hereinabove, the adapter 10 is configured so that the syringe 4 can be connected to the adapter 10 through a series of intuitive and easy connection steps. The adapter 10 is configured such that the steps for removing the syringe 4 from the adapter 10, referred to as compound motion disengagement, require more deliberate action by the user, thereby preventing the user from inadvertently or accidentally removing the syringe 4 from the adapter 10.

With reference to FIGS. 1-3, to connect the syringe 4 to the adapter 10, the user grasps the syringe 4 in a conventional manner. The user aligns the distal portion of the syringe 4 with the connector 12 of the adapter 10, such that helical threads 14 of the connector 12 contact corresponding threads 9 on the shield 8 surrounding the male luer lock 6 of the syringe 4. It is noted, however, that since the adapter 10 is in the disengaged position, the inner member 28 spins freely in both the first direction A and the second direction B. Therefore, if the user were to try to turn the syringe 4 relative to the connector 12, the inner member 28 would also rotate preventing connection therebetween. Instead, the user must press the syringe 4 against the connector 12 in distal direction D with sufficient compressive force to overcome the biasing force of the leaf spring 56. Once sufficient force is applied, the inner member 28 is transitioned to the recessed position.

In the recessed position, the protrusions 64, 66 (shown in FIGS. 12 and 13) of the first locking arrangement 36 are brought into contact with one another. More specifically, once the inner member 28 is in the recessed position, the user can slightly rotate the inner member 28 relative to the housing 16 to established contact and/or engagement between the protrusions 66 of the inner member 28 and protrusions 64 extending from the housing 16. Once the engagement between the first locking arrangement 36 and inner member 28 is established, the inner member 28 is prevented from rotating any farther in the first direction A. Thus, the user can rotate the syringe 4 in direction A relative to the connector 12 to engage the threads 9 of the syringe 4 with the corresponding helical threads 14 of the connector 12. Since the inner member 28 is fixedly engaged with the first locking arrangement 36, twisting the syringe 4 in direction A does not cause the inner member 28 to rotate.

Once the syringe 4 is sufficiently tightly connected to the connector 12 of the inner member 28, the user can release the syringe 4. When the syringe 4 is released, the leaf spring 56 biases the inner member 28 back to the extended position. In the extended position, the inner member 28 and syringe 4 attached thereto can freely rotate in either direction relative to the housing 16. Furthermore, since the inner member 28 rotates in conjunction with rotation of the syringe 4, it would be rather difficult or impossible for the user to remove the syringe 4 from the connector 12 of the inner member 28 when it is in the extended position. Thus, the chance that the user or patient could inadvertently remove the syringe 4 from the adapter 10 is effectively reduced.

To remove the syringe 4 from the adapter 10, the user first pushes the syringe 4 toward the adapter 10, in the same manner described above, to transition the inner member 28 from the extended position to the recessed position. This action is referred to as the first motion or maneuver. Specifically, to disconnect the syringe 4 from the connector 12, the user must rotate the syringe 4 in direction B. However, when the adapter 10 is in the partially engaged position in which it cannot rotate in direction A, it is free to rotate in direction B, meaning that removing the syringe 4 from the connector 12 would be difficult or prevented. Therefore, the user must press the pressing surfaces 74 of the tabs 72 of the second locking arrangement 38. Pressing the tabs 72 is referred to as the second motion or maneuver. Pressing the pushing surfaces 74 causes the tabs 72 to contact and engage the inner member 28. The second locking arrangement 38 prevents the inner member 28 from rotating in either direction A or direction B. Since, in this position, the inner member 28 is prevented from rotating in direction B, the user can easily twist the syringe 4 in direction B to unscrew it from the connector 12. The second locking arrangement 38, however, cannot be engaged when the inner member 28 is in the extended positioned. Unscrewing the syringe 4 from the connector 12 is referred to as the third motion of maneuver.

Figure 17:
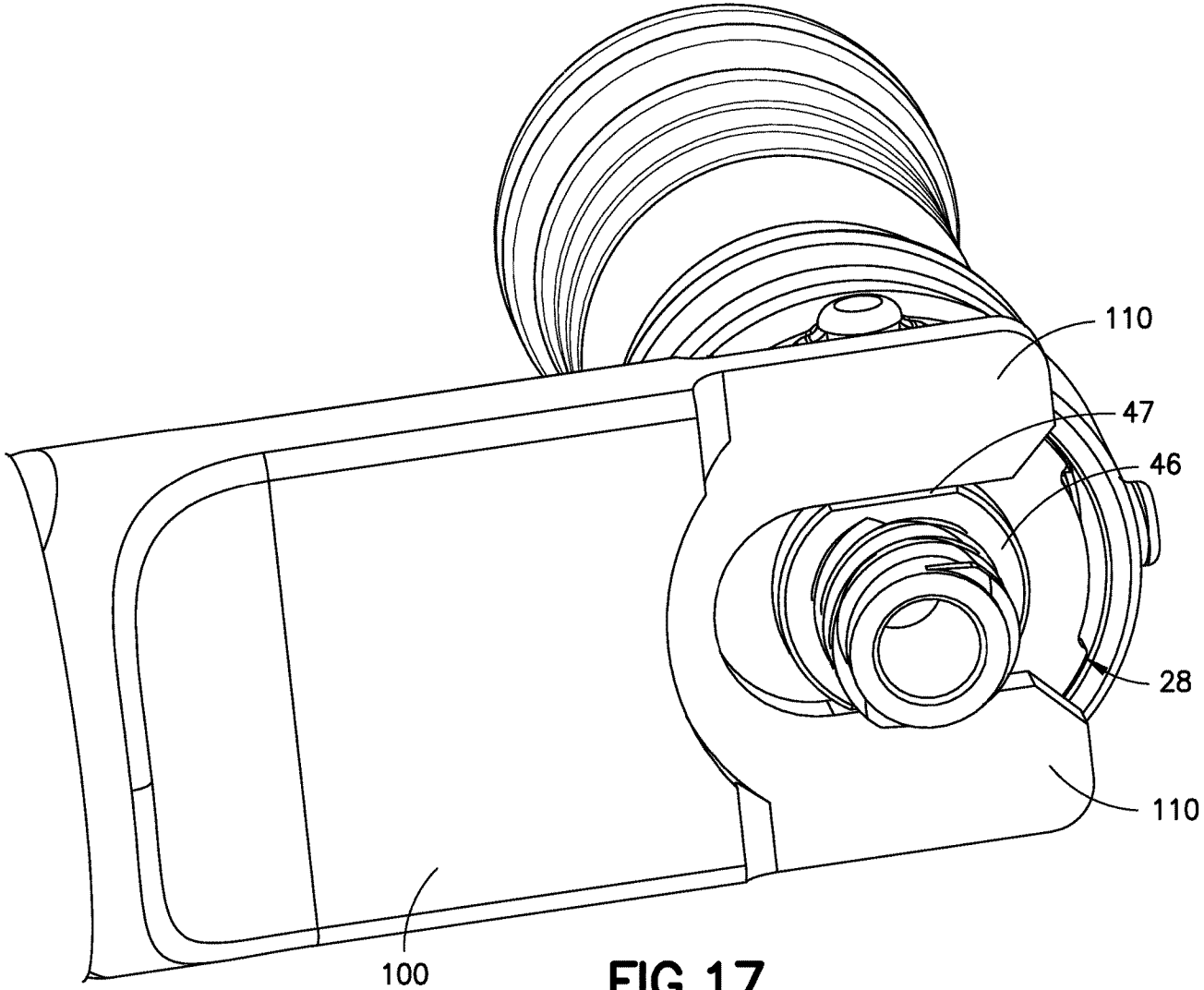
FIG. 17 is a perspective view of an aspect of a removal tool connected to the adapter of FIG. 2 for removing a syringe therefrom.

With reference to FIG. 17, according to another aspect of the invention, a removal tool 100 for removing the syringe 4 (shown in FIG. 1) from the inner member 28 of the adapter 10 is illustrated. The removal tool 100 includes a u-shaped jaw 110 that is configured to contact opposing flats 47 of the pedestal 46 of the inner member 28. When the removal tool 100 is connected to the flats 47, the inner member 28 is prevented from rotating even when it is in the extended position. More simply, the removal tool 100 holds the inner member 28 in place. As such, a user can easily remove the syringe 4 from the adapter 10 without having to manipulate the inner member 28 to engage one of the locking arrangements 36, 38 (shown in FIG. 3). Advantageously, the removal tool 100 could be used if a user must frequently disconnect syringes 4 (shown in FIG. 1) from adapters 10 or in situations in which the user must wear heavy gloves to avoid contacting toxic substances. In such cases, the heavy gloves may make performing the compound motion activities described herein for removing the syringe 4 from the adapter 10 too difficult to perform on a regular basis.

Figure 18A:
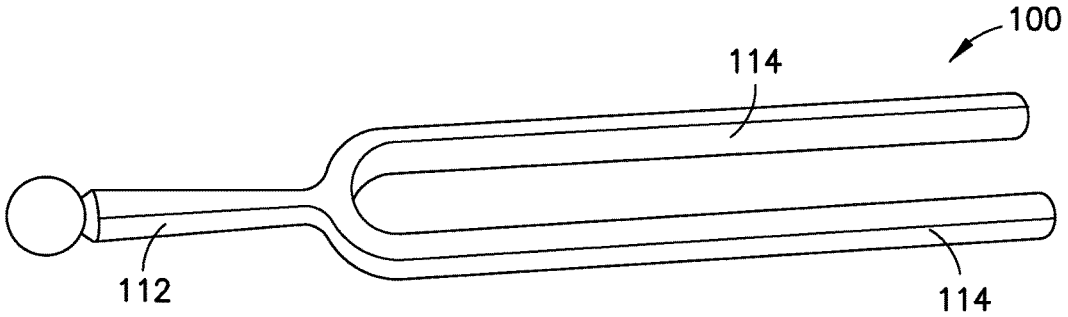
FIG. 18A is a perspective view of a removal tool for removing a syringe from an adapter according to another aspect of the invention.
Figure 18B:
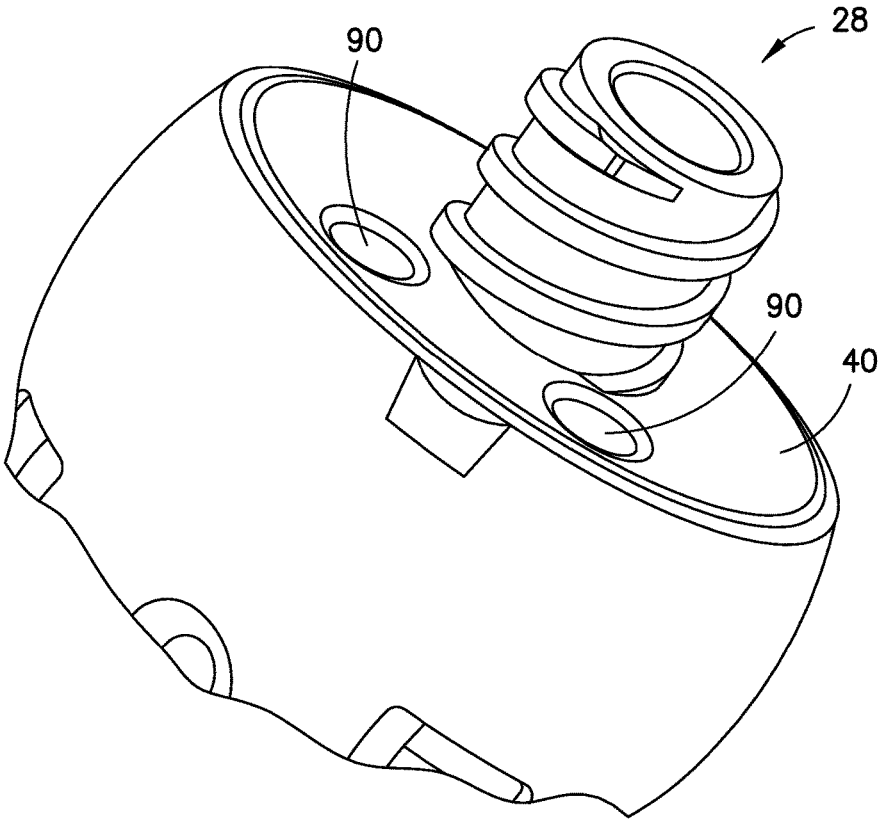
FIG. 18B is a perspective view of an adapter according to another aspect of the invention configured to be disconnected from a syringe with the removal tool of FIG. 18A.

With reference to FIG. 18A, another aspect of a removal tool 100 is illustrated. The removal tool 100 includes a handle 112 having one or more substantially straight legs 114 extending from a distal end thereof. The legs 114 have a substantially circular cross section and are configured to be inserted in a corresponding hole 90 (shown in FIG. 18B), with a corresponding cross section, extending inward from the cap 40 of the inner member 28. The user inserts the legs 114 of the removal tool 100 into the corresponding holes of the inner member 28. When removing the syringe 4 (shown in FIG. 1) from the adapter 10, the user holds the handle 112 of the removal tool 100 with sufficient force to prevent the removal tool 100 and inner member 28 from rotating. In this way, the holes 90 function in a similar manner to the above described pedestal, in that the holes 90 provide a structure or mechanism that engages the removal tool 100 to the inner member 28.

Figure 19:
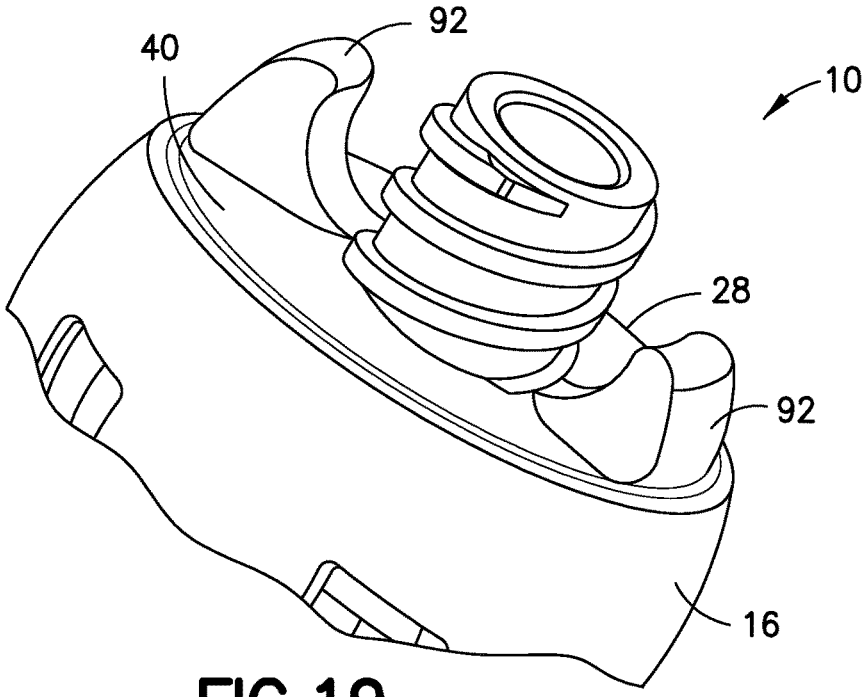
FIG. 19 is a perspective view of a portion of an adapter according to another aspect of the invention.
Figure 20:
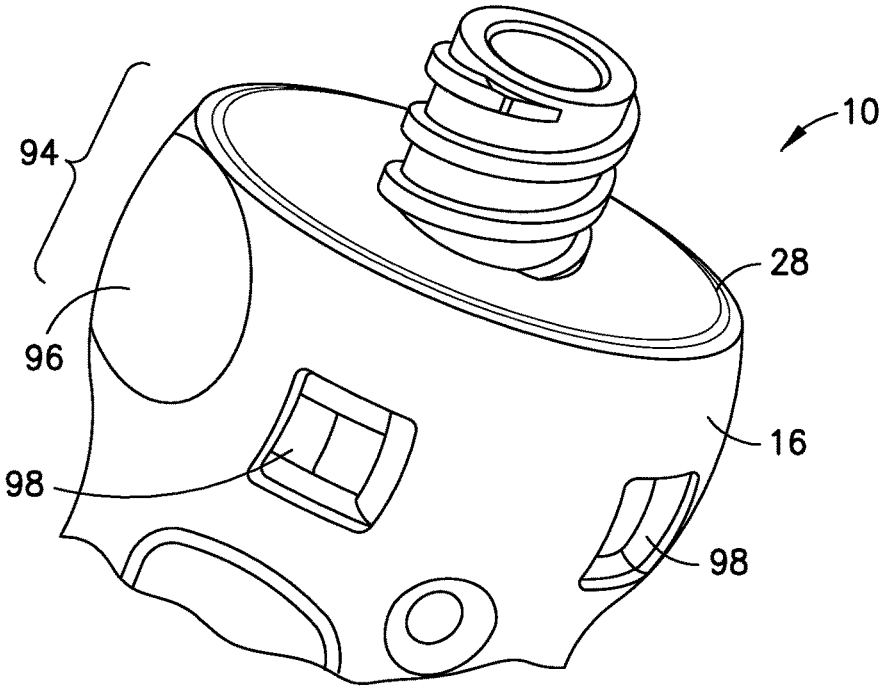
FIG. 20 is a perspective view of a portion of an adapter according to another aspect of the invention.

With reference to FIGS. 19 and 20, additional aspects of adapters 10 with structures for preventing rotation of the inner member 28 relative to the grip housing 16 are illustrated. With specific reference to FIG. 19, grasping surfaces, such as one or more wings 92, may extend from the distal surface of the cap 40 of the inner member 28. When disconnecting the syringe 4 (shown in FIG. 1) from the inner member 28, the user can grasp the wings 92 with one hand with sufficient force to prevent the inner member 28 from rotating. In certain other aspects, the grasping surfaces may be raised ridges, tabs, thumb grooves, or other protrusions, as are known in the art. The grasping surfaces, such as the wings 92 illustrated in FIG. 19, may be easier for a user to hold for certain shapes of fluid sources or syringes and provide an alternative to the tabs 72 of the second locking arrangement 38 described above in connection with other aspects.

With specific reference to FIG. 20, the housing 10 may also include a deformable portion extending about the portion adjacent to the inner member 28. The deformable portion 94 is capable of being pressed against the inner member 28 to restrict rotation thereof. The deformable portion 94 may include recessed pressing surfaces 96 having a curvature that can easily be grasped by the user. When sufficient squeezing force is applied to the pressing surfaces 76, the deformable portion 94 of the housing 16 is biased against the inner member 28 preventing rotation thereof. In certain aspects, the deformable portion 94 of the housing 16 may also include slots 98 adjacent to the pressing surfaces 96. The slots 98 minimize the disconnection force between the deformable portion 94 of the housing 16 and the inner member 28 by limiting the area of contact therebetween. The deformable portion 94 of the housing 16 provides yet another removal option for the user.

Although the invention has been described in detail for the purpose of illustration based on what is currently considered to be the most practical and preferred aspects, it is to be understood that such detail is solely for that purpose and that the invention is not limited to the disclosed aspects, but, on the contrary, is intended to cover modifications and equivalent arrangements that are within the spirit and scope of the appended claims. For example, it is to be understood that the present invention contemplates that, to the extent possible, one or more features of any aspect can be combined with one or more features of any other aspect.

The invention claimed is:

1. An adapter for connection with a fluid container comprising:

an outer housing having a distal end, a proximal end, and a generally cylindrical sidewall extending between the distal end and the proximal end;

an inner member comprising a body rotatably inserted within the outer housing and a connector extending from the body configured to connect the adapter to a fluid container;

a first locking arrangement engageable with the body of the inner member and configured to restrict the inner member from rotating relative to the housing in a first direction; and a second locking arrangement engageable with the body of the inner member and configured to restrict the inner member from rotating relative to the housing in both the first direction and a second direction, wherein the adapter is transitionable between: a disengaged state, in which the first locking arrangement and the second locking arrangement are not engaged with the inner member; a partially engaged state in which the first locking arrangement engages the inner member; and a fully engaged state in which the second locking arrangement engages the inner member.

2. The adapter according to claim 1, wherein the inner member is rotatable in both the first direction and the second direction when the connector is in the disengaged state.

3. The adapter according to claim 1, wherein the inner member is transitionable from an extended position to a recessed position by applying a compressive force to the inner member.

4. The adapter according to claim 3, further comprising a biasing member that maintains the inner member in the extended position.

5. The adapter according to claim 4, wherein the biasing member is a leaf spring.

6. The adapter according to claim 3, wherein the first locking arrangement comprises at least one protrusion extending inward from an inner surface of the sidewall of the housing and a corresponding protrusion on the body of the inner member configured to engage the protrusion on the sidewall.

7. The adapter according to claim 6, wherein the at least one protrusion extending inward from an inner surface of the sidewall of the housing and the corresponding protrusion on the body of the inner member are one-way ratchets comprising a sloped face and a substantially vertical face.

8. The adapter according to claim 1, wherein the first locking arrangement comprises at least two protrusions positioned on opposing circumferential sides of the sidewall of the housing and at least two corresponding protrusions extending from the body of the inner member.

9. The adapter according to claim 1, wherein the second locking arrangement comprises at least one inwardly extending tab connected to a portion of the sidewall of the housing and configured to selectively engage a portion of the inner member.

10. The adapter according to claim 9, wherein the at least one tab comprises a pressing surface configured such that applying a compressive force to the pressing surface biases the tab inward to engage the portion of the inner member.

11. The adapter according to claim 10, wherein the tab is connected to the sidewall of the housing at a flexible joint, such that application of the compressive force to the pressing surface biases the tab inward about the flexible joint.

12. The adapter according to claim 10, wherein the second locking arrangement further comprises a beam that connects the tab to the sidewall of the housing, and wherein applying a compressive force to the pressing surface deflects the beam inward thereby extending the at least one tab toward the inner member.

13. The adapter according to claim 12, wherein the second locking arrangement comprises two beams connected to opposing sides of the tab.

14. The adapter according to claim 9, wherein the second locking arrangement further comprises at least one tooth extending radially from the inner member, the tooth being configured to engage the at least one tab.

15. The adapter according to claim 1, wherein the second locking arrangement comprises at least two inwardly extending tabs positioned on opposing sides of the sidewall of the housing.

16. The adapter according to claim 1, wherein the connector comprises an outer surface with helical threads, configured to engage corresponding threads on an inner surface of a portion of the fluid container.

17. The adapter according to claim 16, wherein the connector comprises a luer connector configured to receive a corresponding luer connector of the fluid container.

18. The adapter according to claim 1, wherein the inner member is transitionable from an extended position to a recessed position relative to the outer member, wherein the inner member is in the disengaged state when in the extended position, and wherein the inner member is in one of the partially engaged state and the fully engaged state when in the recessed position.

19. The adapter according to claim 18, wherein the inner member is in the fully engaged state when the inner member is in the recessed position and when the second locking arrangement is engaged with the body of the inner member.

20. A method of disconnecting a fluid container to an adapter comprising:

providing an adapter comprising:

an outer housing having a distal end, a proximal end, and a generally cylindrical sidewall extending between the distal end and the proximal end;

an inner member comprising a body rotatably inserted within the housing and a connector extending from the body comprising a connector configured to engage with the fluid container;

a first locking arrangement engageable with the body of the inner member and configured to restrict the inner member from rotating relative to the housing in a first direction; and a second locking arrangement engageable with the body of the inner member and configured to restrict the inner member from rotating relative to the housing in both the first direction and a second direction;

moving the fluid container in an axial direction towards the adapter;

engaging the second locking arrangement; and rotating the fluid container to disconnect the fluid container from the inner member of the adapter.

* * * * *